US010589147B1

(12) United States Patent
Kostadis

(10) Patent No.: US 10,589,147 B1
(45) Date of Patent: Mar. 17, 2020

(54) OFFICE TREADMILL

(71) Applicant: Andrew Kostadis, East Windsor, NJ (US)

(72) Inventor: Andrew Kostadis, East Windsor, NJ (US)

( * ) Notice: Subject to any disclaimer, the term of this patent is extended or adjusted under 35 U.S.C. 154(b) by 0 days.

(21) Appl. No.: 16/501,825

(22) Filed: Jun. 11, 2019

(51) Int. Cl.
*A63B 22/02* (2006.01)
*A47B 13/08* (2006.01)

(52) U.S. Cl.
CPC ..... *A63B 22/0235* (2013.01); *A47B 13/08* (2013.01); *A63B 2208/0204* (2013.01); *A63B 2208/0228* (2013.01); *A63B 2210/50* (2013.01)

(58) Field of Classification Search
CPC . A63B 22/02; A63B 22/0235; A63B 22/0242; A63B 22/025; A63B 22/0285; A63B 22/0292; A63B 22/04; A63B 21/015; A63B 21/22; A63B 2208/02; A63B 2208/0204; A63B 2208/0228; A63B 2208/0233; A63B 2210/00; A63B 2210/02; A47B 2220/06
USPC ..... 482/54; 403/46, 83, 84
See application file for complete search history.

(56) References Cited

U.S. PATENT DOCUMENTS 7,780,578 B2 * 8/2010 Packham ..... A63B 22/02 482/4
2012/0264573 A1 * 10/2012 Hsu ..... A63B 69/0064 482/54
2013/0203561 A1 * 8/2013 Lee ..... A63B 22/0235 482/54

* cited by examiner

*Primary Examiner* — Loan B Jimenez
*Assistant Examiner* — Zachary T Moore
(74) *Attorney, Agent, or Firm* — Wei & Sleman LLP

(57) ABSTRACT

An office treadmill allows an office worker to walk while working without compromising the quality and speed of job performance. It consists of a walking device which is easily converted into an office chair. The conversion from treadmill into office chair and vice versa takes about a minute and is not a physically or intellectually challenging task. The office worker can perform the full range of office duties while walking due to the "Stop" element of the Office Treadmill package.

15 Claims, 14 Drawing Sheets

FIG.2D exploded view

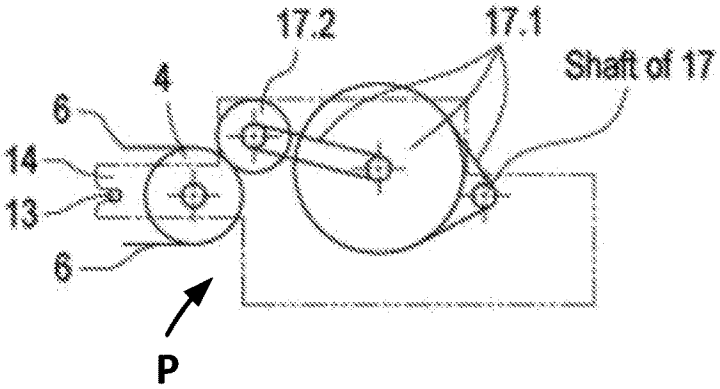
FIG.4D
(Amended)

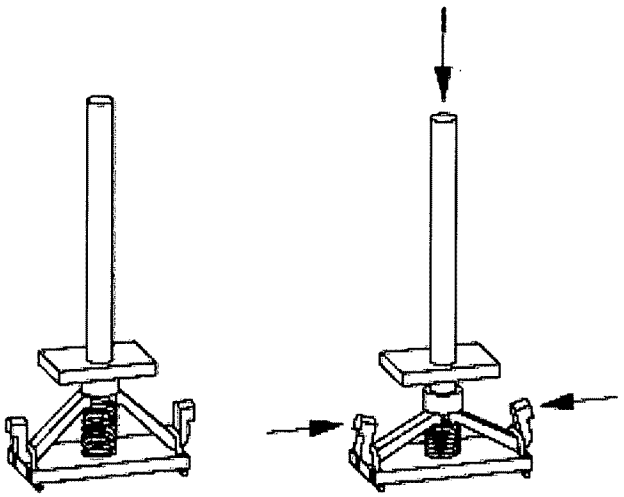
FIG.5C
FIG.5D
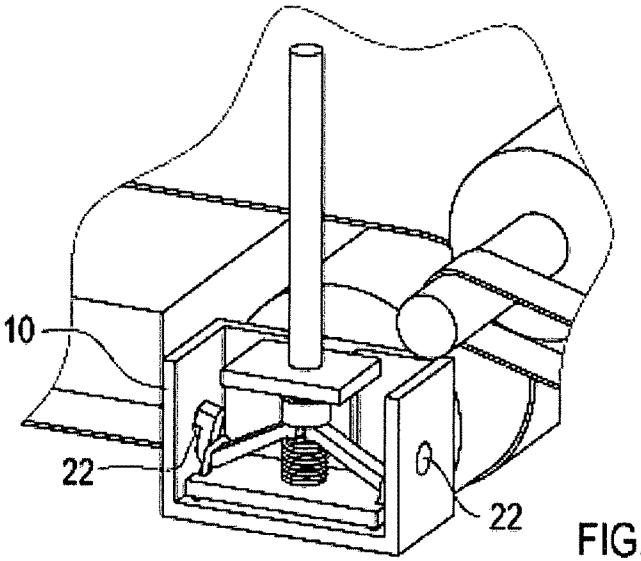
FIG.5E
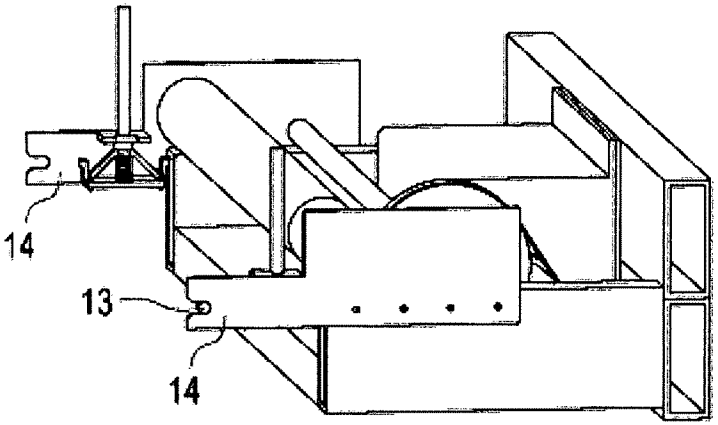
FIG.5A
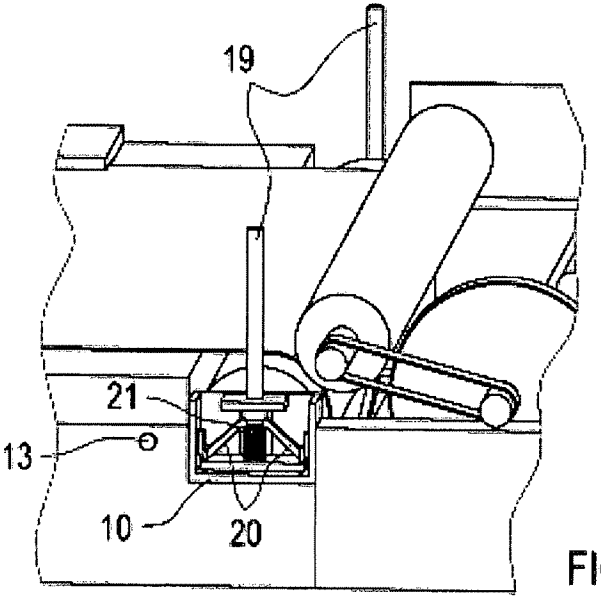
FIG.5B

OFFICE TREADMILL

CROSS-REFERENCE TO RELATED APPLICATIONS

This application claims the benefit of U.S. Provisional Application Ser. No. 62/766,391, filed Oct. 17, 2018, the contents of which are hereby incorporated by references as if fully set forth herein.

BACKGROUND OF THE DISCLOSURE

Individuals who engage in sedentary, office-type work for an extended period usually experience great discomfort, stress, and other health problems associated with the highly hypodynamic nature of office work. Even extensive one-time restriction of movement, like a long air flight, can cause so much discomfort that Boeing Company found it suitable to accept exercise equipment into extremely limited flight space.

Manufacturers have attempted to solve office workers' difficulties by supplying the market with a variety of exercise devices. Under-the-desk treadmills, coupled with adjustable height office desks or over-the-desk stands, are among the most popular. However, the typical treadmill is athletic-oriented equipment and provides ambiguous workforce functionality involving high speed options, workout programs, vital reading sensors, etc. Such sports features may be unnecessary and counterproductive for a work environment.

SUMMARY OF THE DISCLOSURE

In some embodiments, a convertible treadmill that can be converted into a chair for office work includes a motor to keep the platform in motion as part of the power unit, a walking platform which can be folded into several segments, and a mechanical obstacle.

BRIEF DESCRIPTION OF THE FIGURES

Various embodiments of the presently disclosed devices are shown herein with reference to the drawings, wherein:

FIG. 3A shows an exploded view of a locking mechanism;

FIG. 3B shows assembly of the locking mechanism in a locking position;

FIG. 3C shows the locking mechanism in a turning position, when the handle is pulling the puller out of the locking holes;

FIG. 4D shows the schematics of a power unit;

FIGS. 5A-E depict the mechanics of the connecting mechanism which joins the power unit and Part A of the walking platform;

Figure 1:
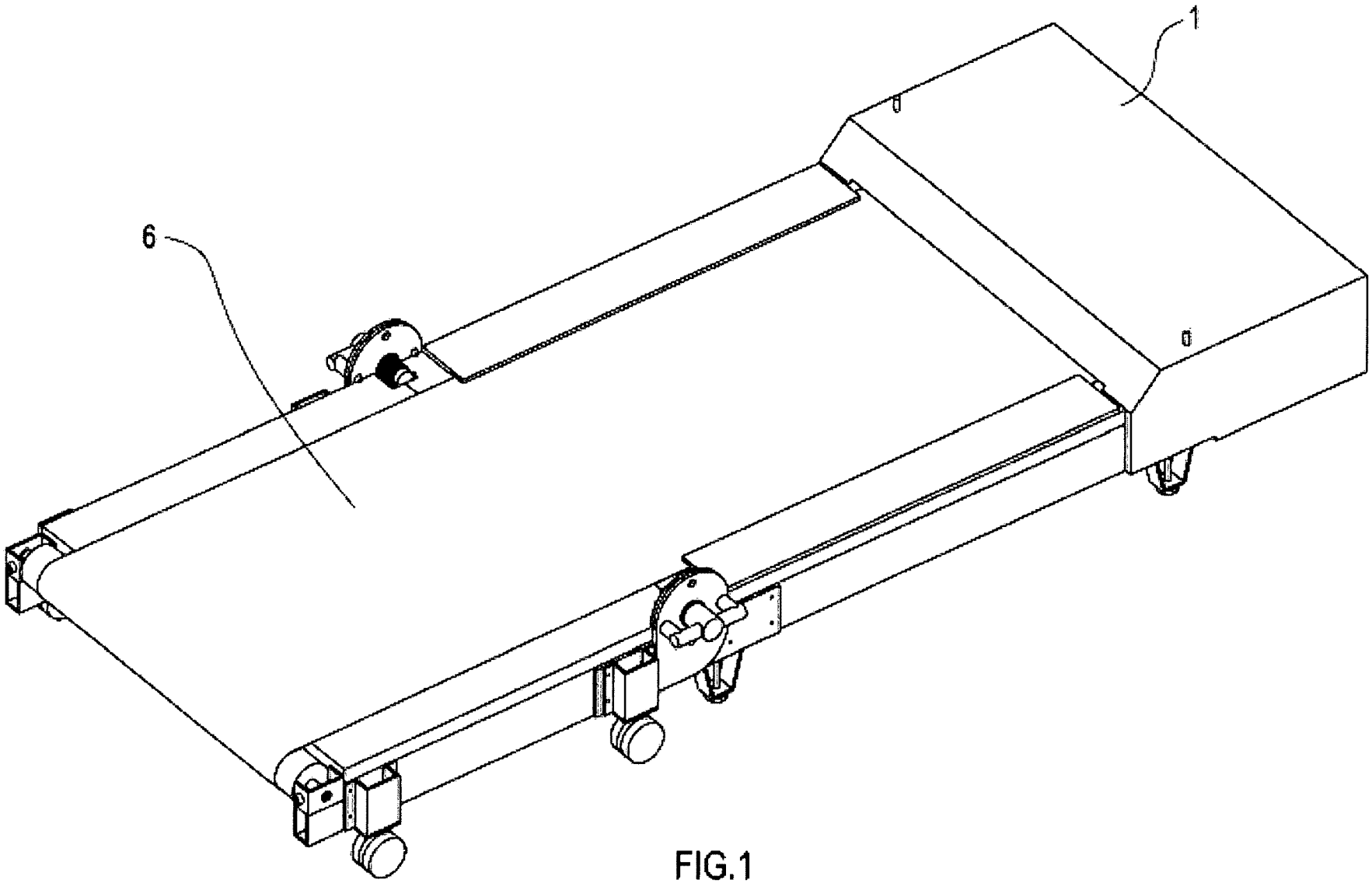
FIG. 1 shows on embodiment of an office treadmill in the unfolded treadmill position.

Various embodiments of the present invention will now be described with reference to the appended drawings. It is to be appreciated that these drawings depict only some embodiments of the invention and are therefore not to be considered limiting of its scope.

DETAILED DESCRIPTION OF THE FIGURES

Despite the various improvements that have been made to exercise equipment and their methods of use, conventional devices suffer from some shortcomings as described above. There therefore is a need for further improvements to the devices, systems, and methods of providing exercise to office workers. Among other advantages, the present disclosure may address one or more of these needs. As used herein, the phrase "Walking Platform" in the text below has the same meaning as the combination of words "walking," "running," and/or "jogging" correlated to the word "platform."

The present disclosure describes a treadmill that is not sports equipment. Prior art devices permit exercise but limit the scope of office work and compromise the speed and quality of office work. Conversely, the instant device provides only a very light fitness effect; its design helps sedentary workers move, namely walk, while performing office duties. The fitness result of taking a few pounds off the belly is a natural outcome, not a goal, of this invention. Different goals imply different technical implementations. For example, the range of maximum speed suitable for "working-while-walking" cannot exceed 1-2 mph, contrasted with existing under-the desk treadmills which allow speeds up to 4-6 mph. Higher speed requires a more powerful motor, wider walking belt, stronger and wider rollers, etc. As a result, existing sports and fitness equipment are excessively heavy, oversized, and overpriced compared to the present devices.

Similar principles apply to the "Stop feature", included in one embodiment of the Office Treadmill package. Almost all treadmill models have handles which can be used to support the user from falling during exercise and to stop them from moving forward. An exercising person may unintentionally lean on those handles, partially benefitting from the effect provided by the Stop proposed in the Office Treadmill patent. However, none of the "occasional" stops on existing treadmills are specifically designed to provide the condition which is essential for an office environment. Office Treadmill's Stop feature lets the lower body move, namely walk, while the upper body and hands are absolutely free to perform any "over-the-desk" office work, providing specific, optimum "working-while-walking" conditions.

Additionally, no existing models found in this search of treadmills or other automated sport models provide the separation and foldability of the Power Unit from the Walking/Running Platform. This feature allows the Walking/Running Platform to be further collapsed and transformed into new office equipment (like an office chair), providing better storage and transportation conditions.

From a "working-while-walking" in office perspective, most existing models reviewed appear bulky, expensive, over-featured, and/or not suitable for the reality of the office environment. Office workers and their employers are looking for equipment suited to improve the working environment without compromising workers' ability to perform their offices duties. Obviously, the opportunity to exercise while working is the best solution for both workers and employers.

In answer to this demand, the Office Treadmill should incorporate the most lightweight, portable, and foldable design possible, similar to the manual model presented herein.

Furthermore, it is obvious that workers cannot walk while working the entire day and keeping the treadmill desk in the upright position is not a pleasant option for a small office or cubical. Correspondingly, the Office Treadmill is built easily transportable and quickly convertible from treadmill to office chair and vice versa.

A better way to organize office "working-while-walking" workspace has also been developed. The adjustable height Over-the-Desk Platform is proposed in place of the current adjustable height office desk. The biggest advantage of the adjustable height office desk over the limited work surfaces provided by various models of over-the-desk stands is that the adjustable height office desk permits the entire working desk to be kept intact during its transformation from sitting to standing position and vice versa. The Over-the-Desk Platform, proposed as a part of Office Treadmill invention, permits use of the existing office desk instead of requiring purchase of costly raised office tables. Use of the Over-the-Desk Platform on existing desk furniture allows easy reach of objects on the desk while the worker walks on the Office Treadmill. This condition is achieved due to the "Stop." The Stop is a physical object, like a square piece of plastic, which restricts forward body movement while the office worker uses the Office Treadmill. The Stop proposed below has two distinctive features, differentiating it from supplemental or naturally-occurring stops:

The Stop is designed for only one specific purpose, to restrict the body from moving forward during "working-while-walking" activity.

The design of the Stop secures steady positioning of lower body movement and frees upper body and arms for any possible kind of desk work. The user's upper body and arms are completely free during his or her walking session with the same unrestricted freedom of movement as if the worker were sitting in the office chair.

In the proposed design, the Stop functions as a component of Over-the-Desk Platform and can also be coupled with adjustable height office desks, or it can be designed differently to function as a separate device.

Leaning on the Stop by the waist area, maintaining a slow walking pace, and adjusting the height of the Over-the-Desk Platform enables the office worker to walk automatically and seamlessly for optimal concentration on the job.

The Office Treadmill is equipment that allows an office worker to benefit from "working-while-walking" activity without compromising the quality and speed of his or her office duties.

The main principles behind the Office Treadmill are:

The Office Treadmill may incorporate movement in office workers' processes without limiting their ability to perform their office job;

The treadmill may naturally fit into a small office cubical space and transform into office furniture like a desk, chair, shelving, etc.

The proposed model of the Office Treadmill is a treadmill and office chair in one unit. The entire treadmill construction can be manually converted into a fully-functional chair base suitable for office work due to two innovative features incorporated into the Office Treadmill model:

The Power Unit can be separated from the Walking Platform.

The separated from the Power Unit, or stand alone Walking Platform can be folded to form an office chair (in the proposed embodiment) or can be collapsed for smaller storage space and better transportation condition.

FIG. 1 shows Office Treadmill in the unfolded Treadmill position. The embodiment consists of Walking Platform and Protective Cover (1) which is displayed over the Power Unit. Walking Belt (6) is placed over the Walking Platform.

Figure 2A:
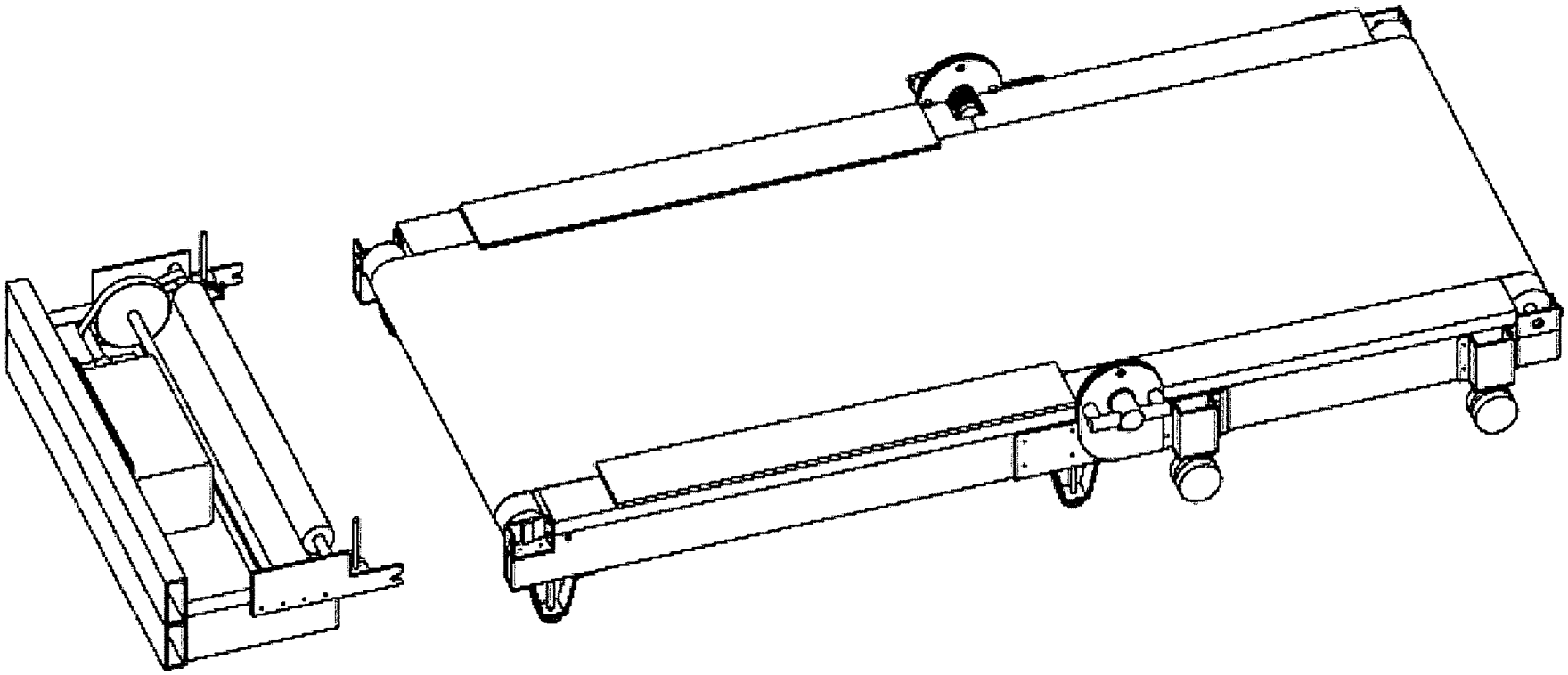
FIG. 2A shows a power unit (on the left) without a protective cover and disconnected from the walking platform (on the right)

FIG. 2A presents the Power Unit (on the left) without Protective Cover (1; see FIG. 1) and disconnected from the Walking Platform (on the right).

Figure 2B:
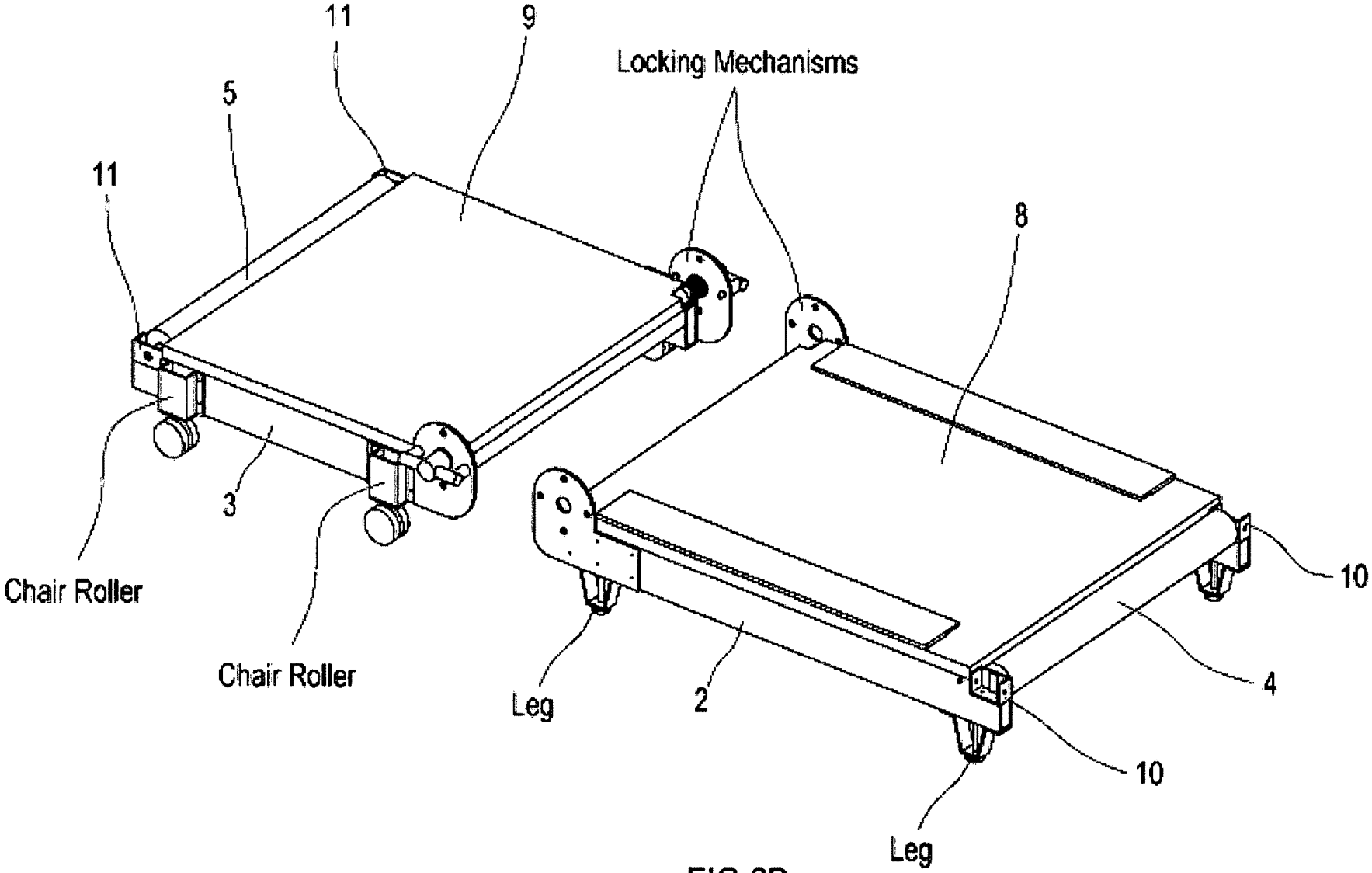
FIG. 2B illustrates the primary components of the walking platform.

FIG. 2B illustrates the primary components of the Walking Platform. In general, Walking Platform consists of Part A (on the right, having legs (12)), Part B (on the left, having rollers (18)), and two Locking Mechanisms (7) on both sides of the Walking Platform.

Figure 2E:
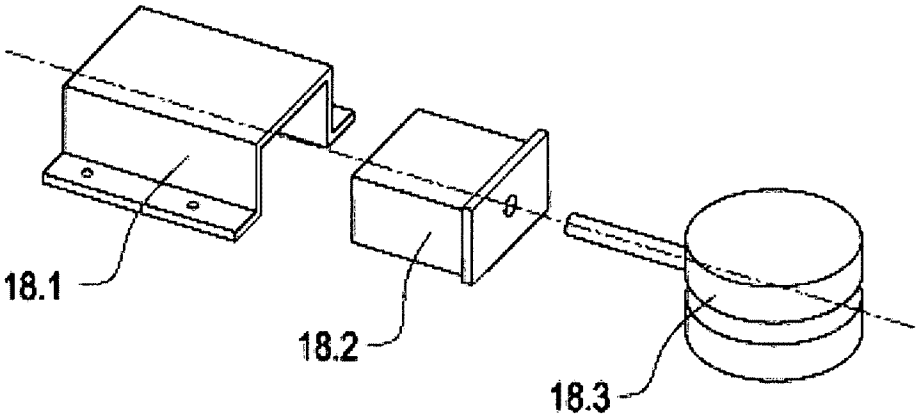
FIG. 2E depicts one treadmill adjusting mechanism for an adjustable following roller.
Figure 2E:
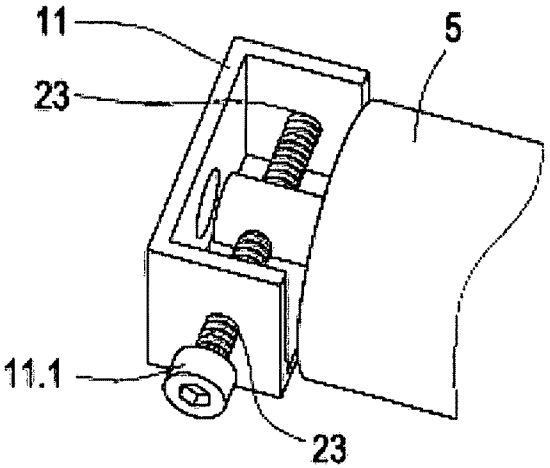
Figure 2C:
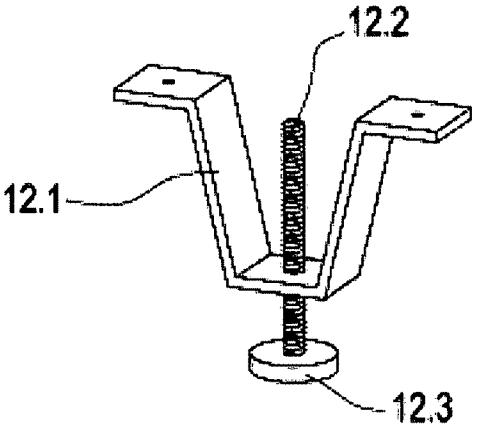
FIGS. 2C and 2D shows one embodiment of lags attached to a frame and office chair rollers attached to another frame.
Figure 2D:
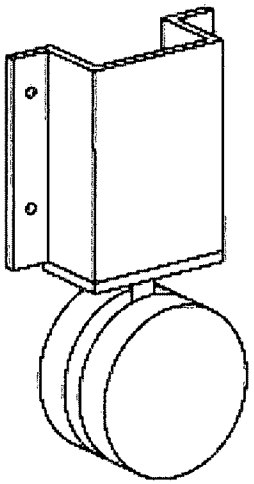

FIGS. 2C and 2D shows proposed design of a Lags attached to the Frame A and Office Chair Rollers attached to the Frame B consecutively.

FIG. 2E depicts typical treadmill Adjusting Mechanism for Adjustable Following Roller (5).

Figure 3A:
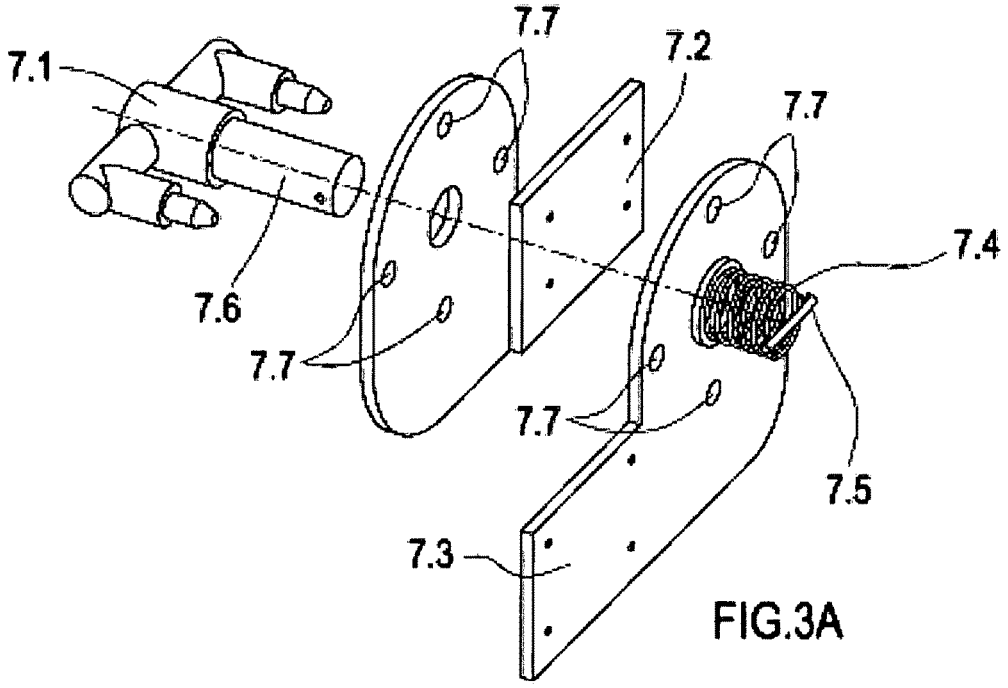
FIGS. 3A, 3B, and 3C show embodiments of locking mechanisms connecting two parts together to permit the locking positions of certain parts.
Figure 3B:
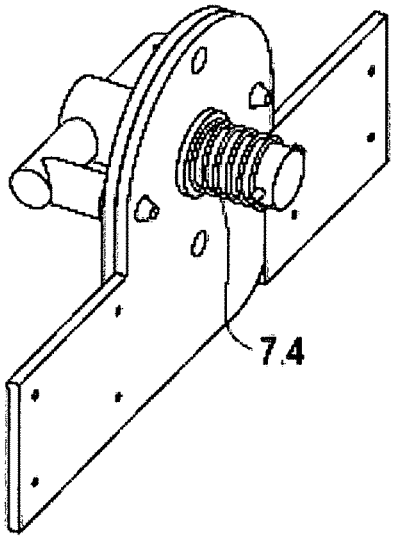
Figure 3C:
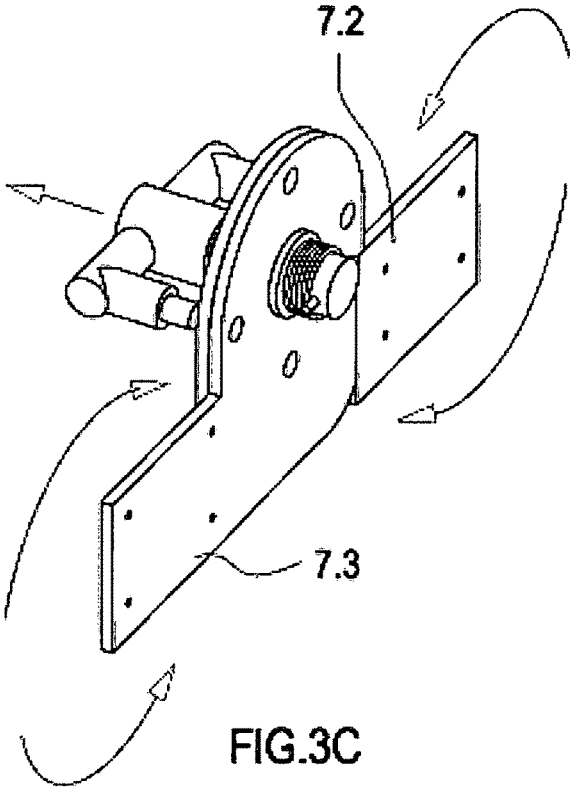

FIGS. 3A, 3B, and 3C

FIGS. 3A, 3B, and 3C present proposed Locking Mechanisms connecting Part A and Part B together to permit the locking positions of Walking Platform parts.

FIG. 3A presents Exploded view of Locking Mechanism.

FIG. 3B shows assembly of the Locking Mechanism in locking position. Spring (7.4) pushes the Puller (7.1) into Locking Holes (7.7).

FIG. 3C presents the Locking Mechanism in turning position, when the Handle is pulling the Puller (7.1) out of the Locking Holes (7.7). In this position Turning Plates 1 (7.2) and Turning Plate 2 (7.3) are free to turn around the Puller (7.1).

Figure 4B:
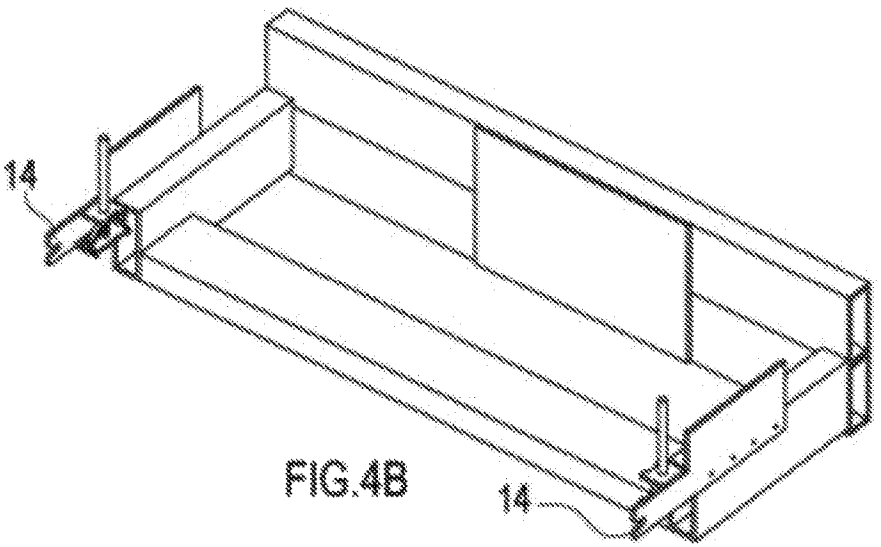
FIG. 4B shows the connecting mechanism attached to the frame.
Figure 4A:
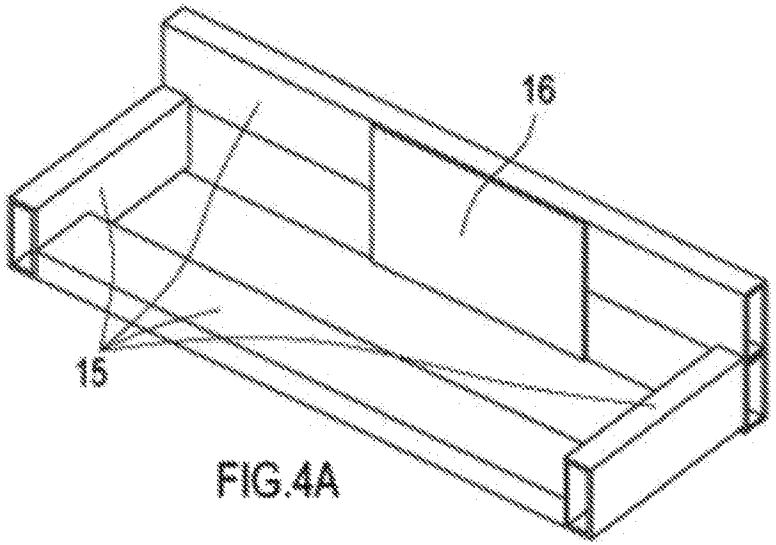
FIG. 4A shows the frame of a power unit.

FIG. 4A shows the frame of Power Unit.

FIG. 4B shows the Connecting Mechanism attached to the frame.

Figure 4C:
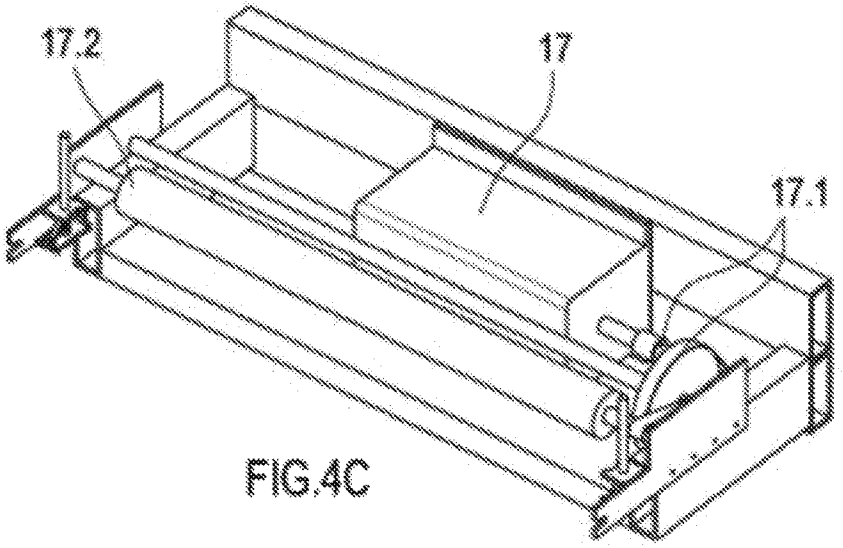
FIG. 4C shows the reduction of speed from an electrical motor to a moving roller.

FIG. 4C shows the reduction of speed from Electrical Motor (17) to the Moving Roller (17.2).

FIG. 4D shows the schematics of the Power Unit.

FIGS. 5A, 5B, 5C, 5D and 5E depict the mechanics of the Connecting Mechanism which joins the Power Unit and Part A of the Walking Platform.

FIG. 5A shows the Connecting Mechanism behind Holding Hand (14).

FIG. 5B shows the Connecting Mechanism in Locking Position.

FIG. 5C shows the Connecting Mechanism alone.

FIG. 5D shows the Connecting Mechanism; Pushing Rod (19) is pushed down, turning Locking Pins (20).

FIG. 5E shows the Pushing Rod (19) pushed down, turning Locking Pins (20). Locking Pins (20) are out of Holes at the Supportive Bracket (22). Power unit is free to be disconnected from the Part A of Walking Platform.

Figure 5F:
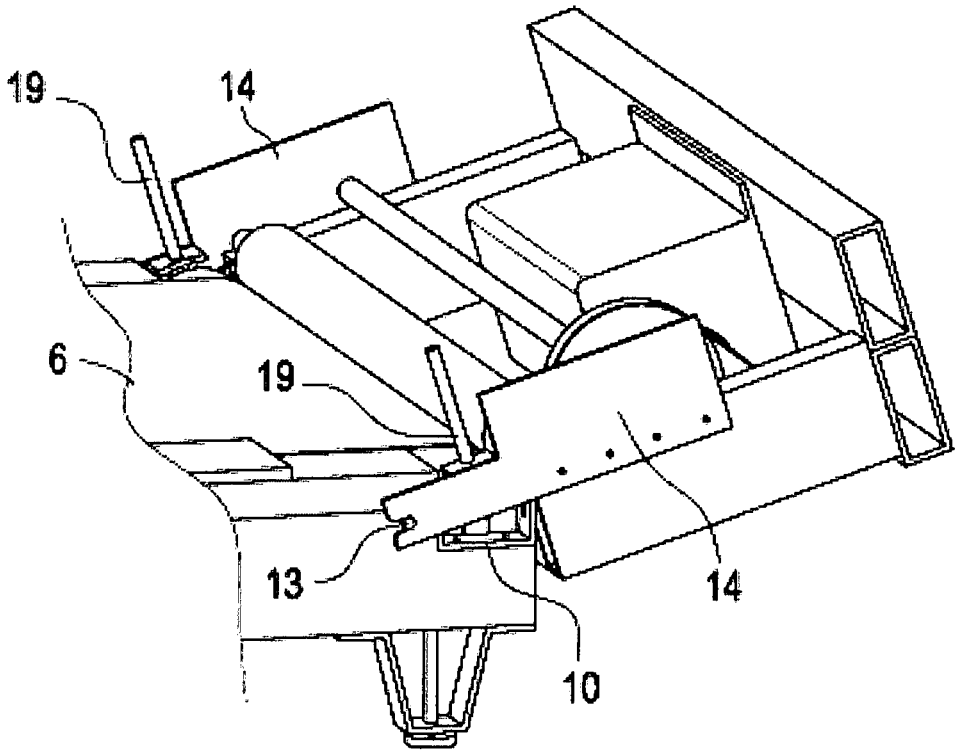
FIGS. 5F and 5G show schematics for the connection process of the power Unit to the walking platform.
Figure 5G:
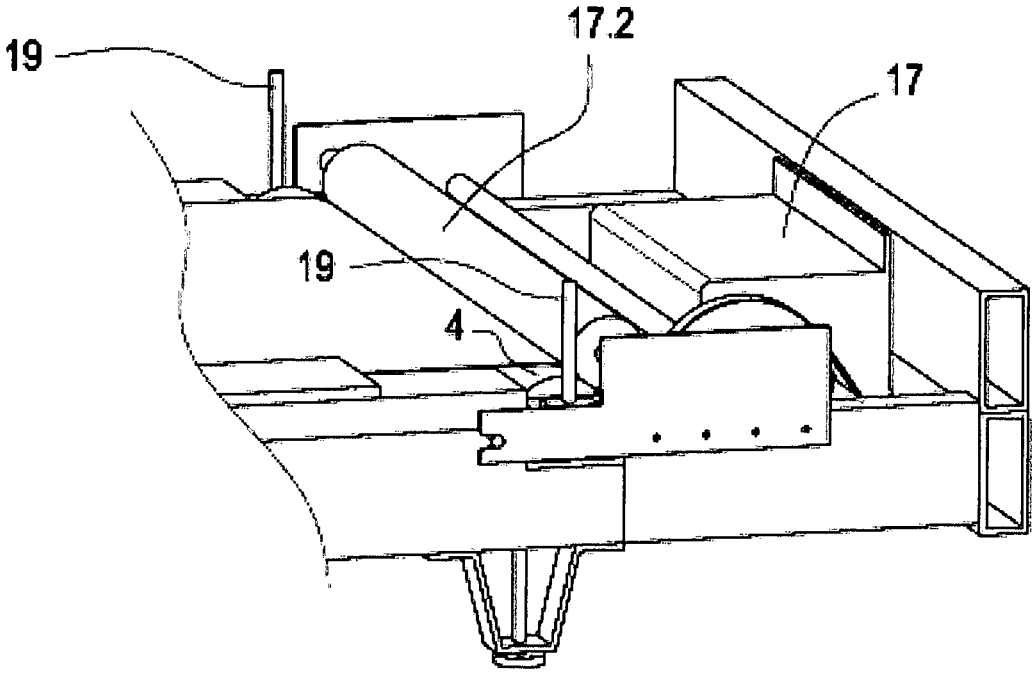

FIGS. 5F and 5G provide schematics for the connection process of the Power Unit to the Walking Platform. (For illustration clarity, the Protective Cover (1, See FIG. 1) over the Power Unit is not shown.)

FIG. 5F shows Holding Hands (14) placed over Connecting Pins (13). At this position, Pushing Rods (19) are pushed down and Locking Pins (20, See FIG. 5) can enter Holes (22) of the Supportive Brackets (10).

FIG. 5G When the Power Unit is in this position, both Pushing Rods (19) are released and Locking Pins (20) penetrate Holes (22) at the Supportive Bracket (10, See FIG. 5), connecting the Power Unit to the Part A of the Walking Platform. Moving Roller (17.2) than pushed down toward the Running Belt (6) and Leading Roller (4). Rotation can then be transferred from the Electrical Motor (17) to the Leading Roller (4) of the Walking Platform.

Figure 6:
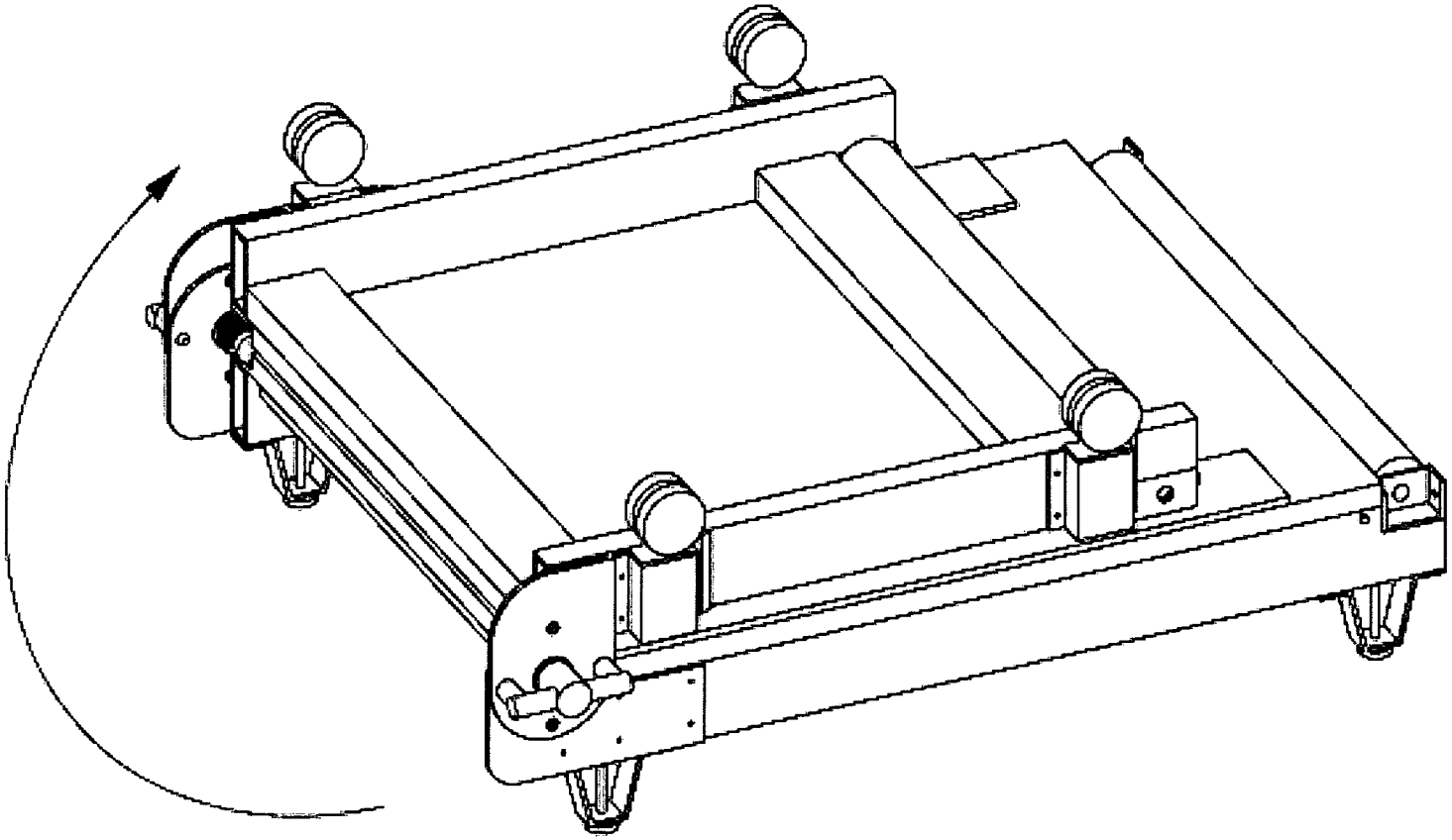
FIG. 6 shows the folded or "Transportation" position of the walking platform without the walking belt.

FIG. 6 presents the folded or "Transportation" position of the Walking Platform without the Walking Belt.

FIGS. 7A, 7B, 7C, 7D, 7E, and 7F illustrate the steps to transform Office Treadmill from a treadmill into an office chair and vice versa.

Step One

Disconnect the Power Unit from the Walking Platform (this process is the backward to the process shown on FIGS. 5F and 5G).

Step Two

Attach Vertical Chair Frame (24) to the Walking Platform.

Step Three

Adjust the Horizontal Bar (26) to a certain height by using the Tightening Screws (25) on both sides of vertical Chair Frame (4).

Step Four

Release Locking Mechanism (7) on both sides of the Walking Platform, then, to lift Part A of the Walking Platform, turn it and rest it on the Horizontal Bar (26) of the Vertical Chair Frame (24).

Step Five

Figure 7A:
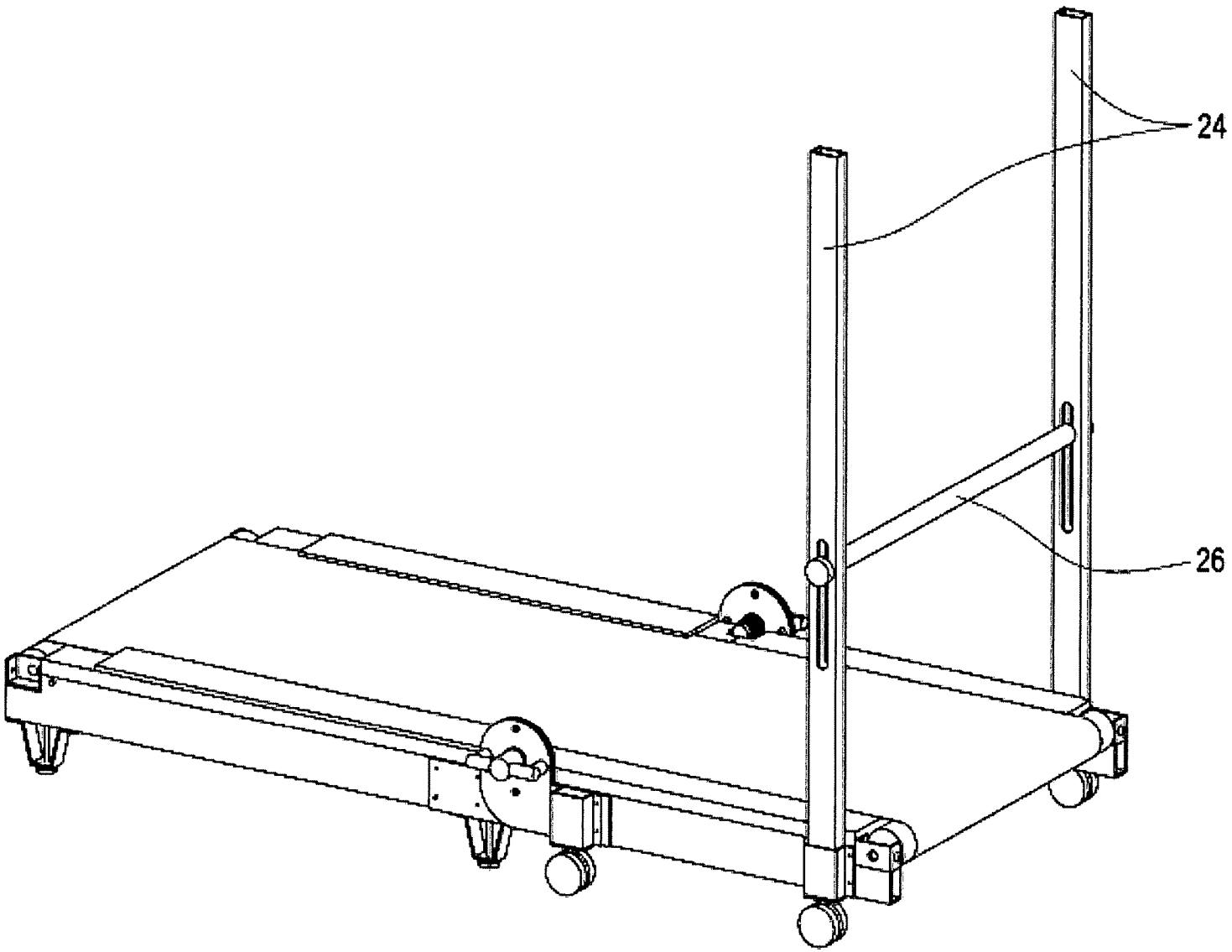
FIGS. 7A-F illustrate the steps to transform from a treadmill into an office chair and vice versa.
Figure 7C:
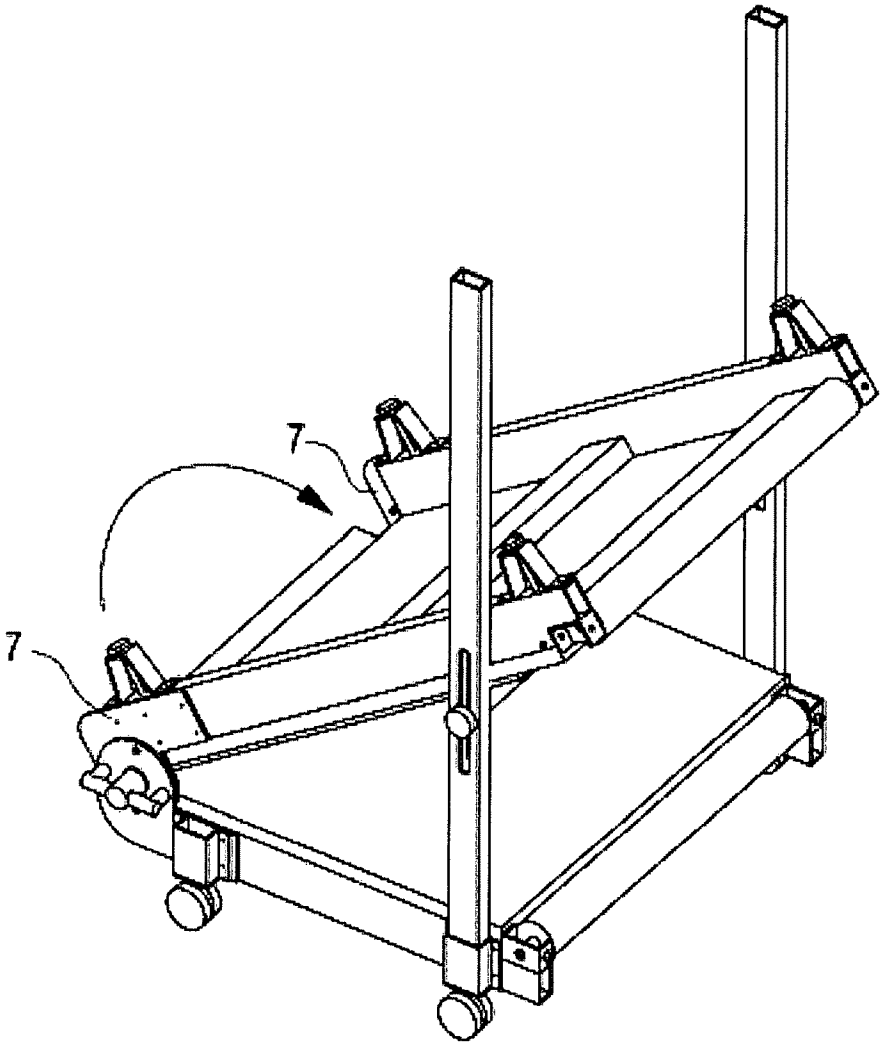
Figure 7B:
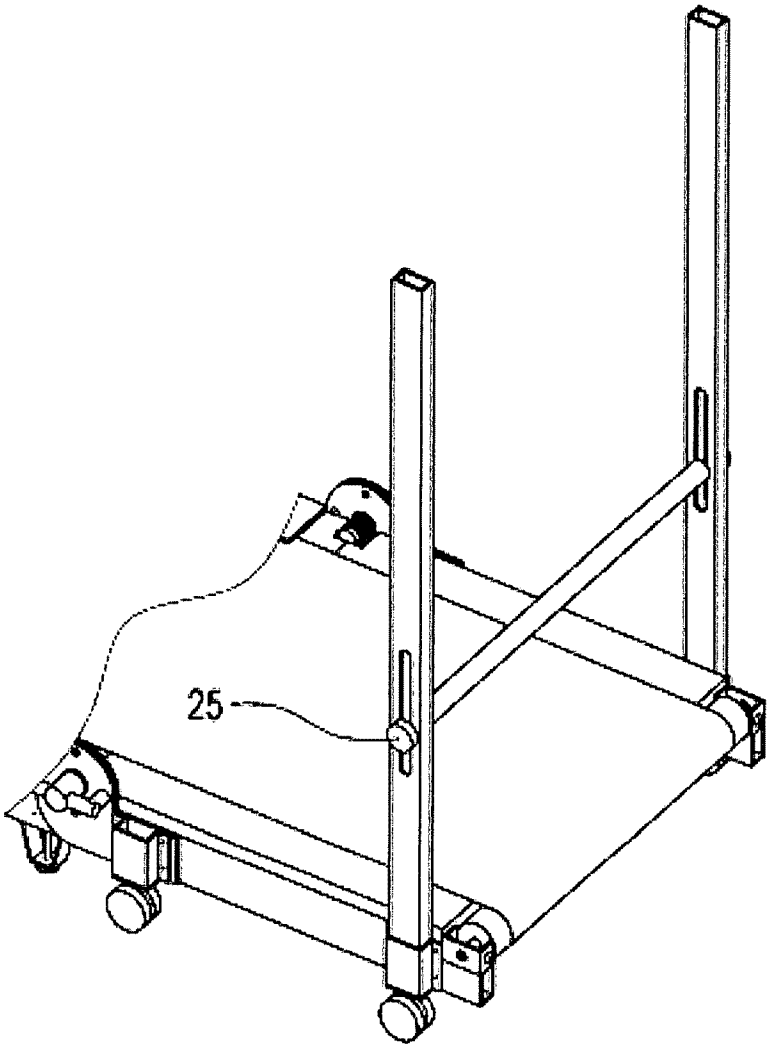
Figure 7D:
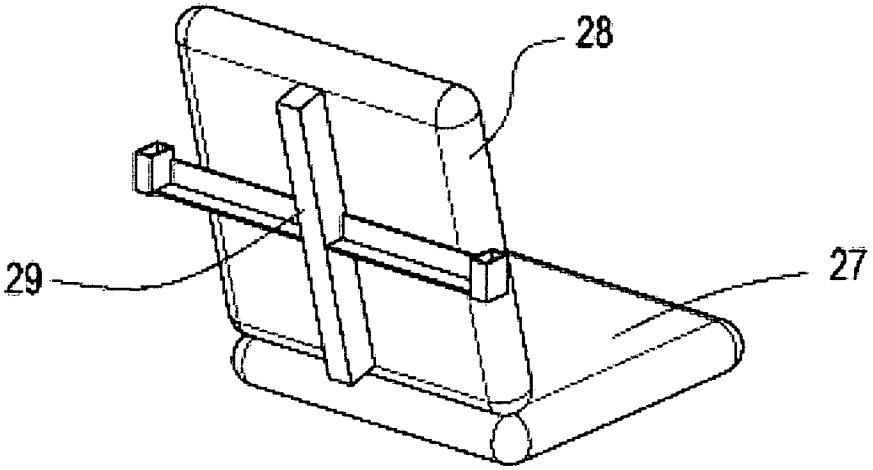
Figure 7F:
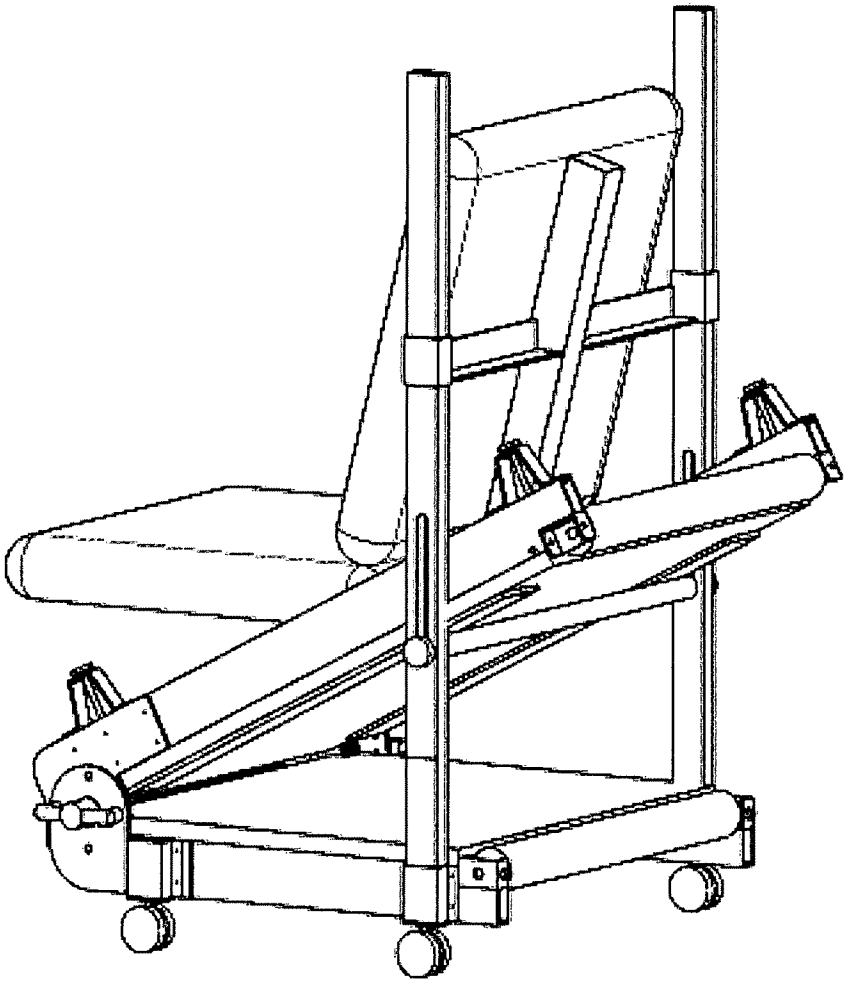
Figure 7E:
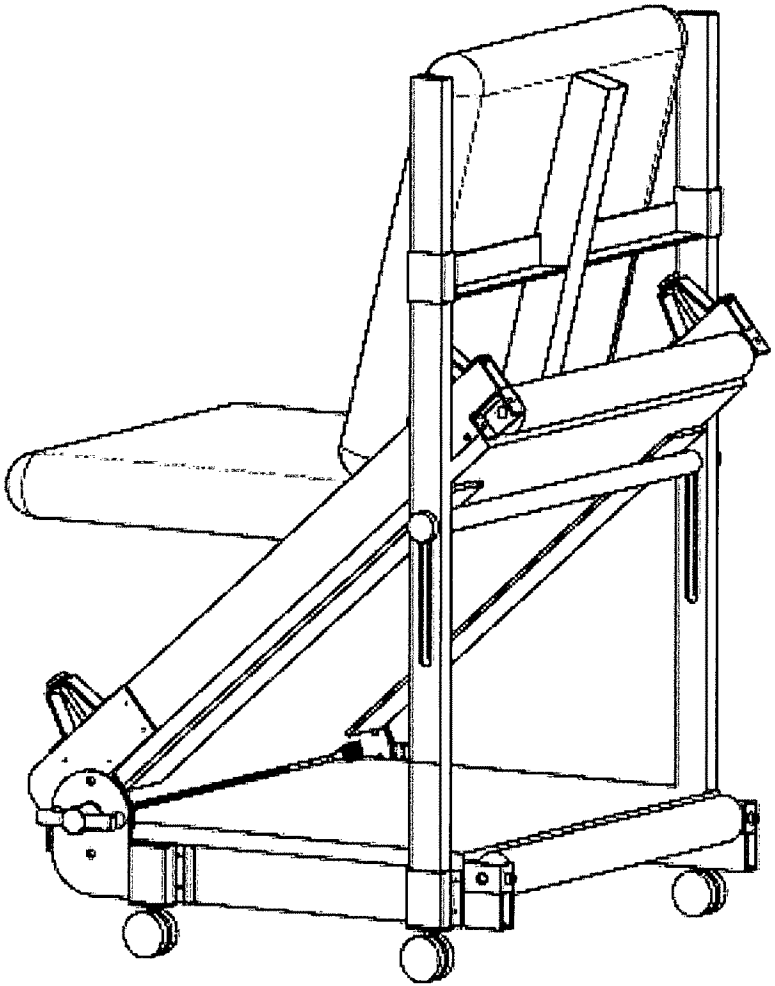

Place Soft Chair Parts over the Vertical frame (24) as shown on FIGS. 7E and 7F. FIG. 7E shows the Soft Chair Parts adjusted to maximum height and FIG. 7F to minimum height above the floor level.

Figure 8:
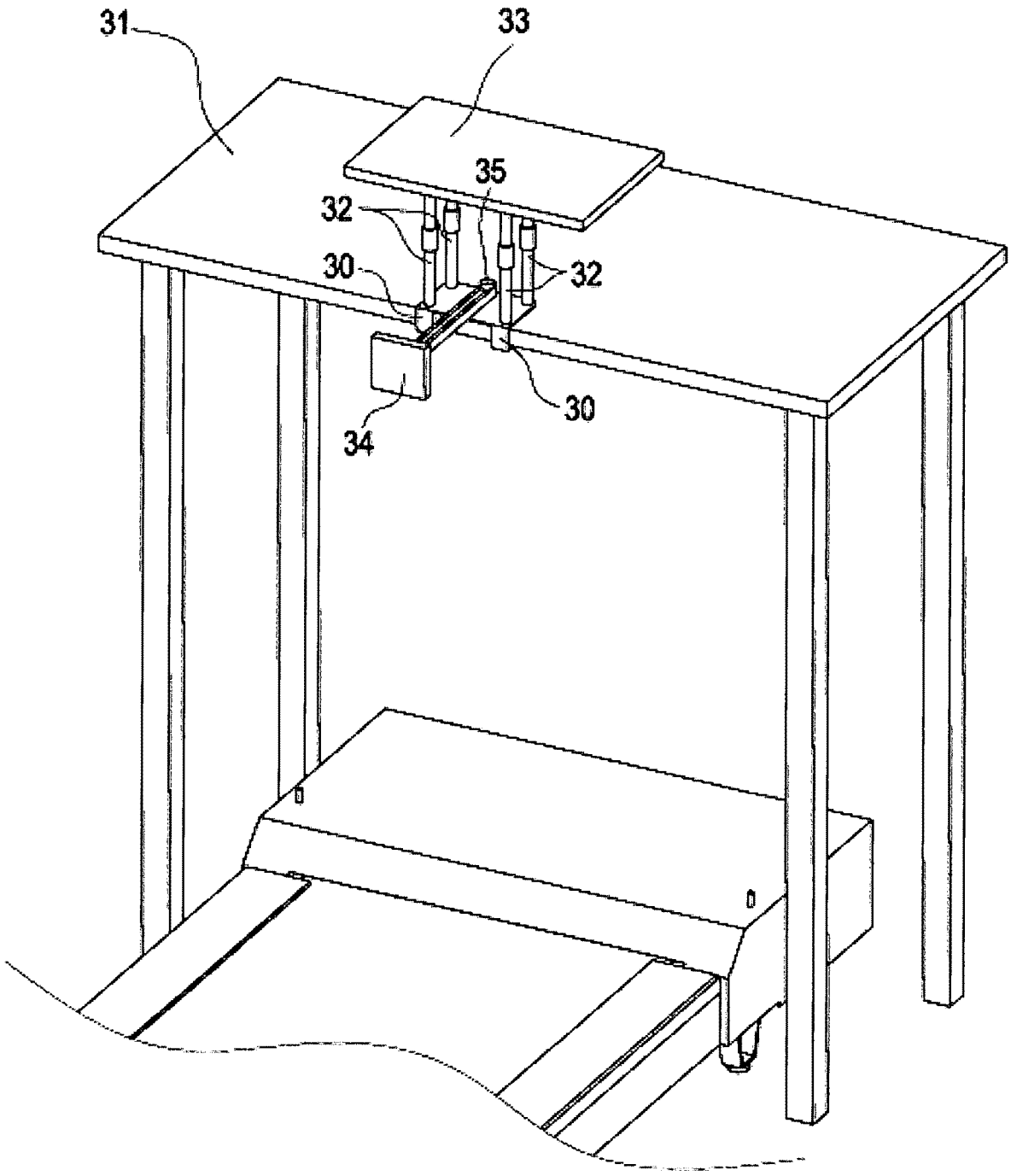
FIG. 8 illustrates an over-the-desk platform.

FIG. 8 illustrates Over-the-Desk Platform.

FIG. 1 presents Office Treadmill in "Treadmill" or "Walking" position while FIGS. 2A and 2B show close-ups of the main Office Treadmill parts. Traditionally, the treadmill comprises of one embodiment where Power Unit is permanently connected to the Walking platform by sharing a mutual frame. Also, traditionally, the Power Unit transfers rotation from electrical motor to a leading roller of Walking Platform using a belt drive system.

Office Treadmill proposes the design in which the Power Unit can be disconnected, folded from the Walking Platform, or incorporated into one of the parts of the Walking Platform in order to allow the Walking Platform to be folded into several parts. Proposed Walking Platform design consists of two folding parts (FIGS. 2A and 2B). Part A and Part B of Walking Platform are connected by a Locking Mechanism detailed in FIG. 3. Locking Mechanism connects Part A and Part B when Office Treadmill is in each of the below depicted positions. Except in the "Chair" position, the Locking Mechanism plays its primary role, which is to lock, i.e. to fasten, Part A and Part B toward each other, forming different functional positions of the Office Treadmill.

The proposed design requires three main positions for Walking Platform:

"Treadmill" or "Walking" position (FIG. 1),

"Folded" or "Transportation" position (FIG. 6), and

"Chair" position (FIGS. 7A, 7B, 7C, 7D, 7E and 7F).

FIG. 2B shows an expanded view of the Walking Platform. Part A of the Walking Platforms consists of Frame A (2) of Walking Platform Part A, Walking Desk A (8), Leading Roller (4) and two Supportive Brackets (10). Supportive Brackets (10) support the Leading Roller (4). Four Legs attach to the Frame A of Walking Platform (2). Part B of the Walking Platform consists of Frame B (3) of Walking Platform Part B, Walking Desk B (9), Adjustable Following Roller (5), and two Brackets with Adjusting Mechanism (11). Brackets (11) support the Adjustable Following Roller (5) and allow adjustment, as the name suggests, of the Adjustable Following Roller (5). An adjusting roller is a typical part of any treadmill and requires no further explanation. Drawing of Adjusting Mechanism is shown at FIG. 2E. Part B of the Walking Platform also has four Office Chair Rollers. Their typical design is shown at FIG. 2D.

FIGS. 3A, 3B, and 3C present proposed a simple Locking Mechanisms connecting Part A and Part B together to permit the locking positions of Walking Platform parts.

Detail (15) on FIG. 4 presents the Main Frame of the Power Unit (P). In proposed design, the Motor Mounting Plate (16) and Connecting Mechanisms are permanently attached to both sides of the Power Unit The Electrical Motor (17) mounts over the Motor Mounting Plate (16). For simplicity of presentation, all electrical details (Electrical Power Supply, Controller, Main Switch, Wirings, Remote Control for the Electrical Motor, etc.) are omitted on all drawings. FIG. 4 also shows the kinematics of the Power Unit (P), as follows. The Power Unit (P) reduces the rotation of the Electrical Motor (17) and transfers the rotation to the Moving Roller (17.2). When the Power Unit (P) is connected to the Walking Platform, the Moving Roller (17.2) is pushed toward the Walking Belt (6) and then to the Leading Roller (4), thereby transferring the rotation from the Electrical Motor (17). The proposed friction drive kinematics is one of the simplest possible reducing models and can be improved, changed, or designed differently way. Each contemporary treadmill needs to provide rotation reduction from the electrical motor to the leading roller of the Walking platform, but the torque must be transferred differently when the Power Unit (P) can be disconnected from the Walking Platform. FIG. 4D presents one alternative scenario of this transformation rather than the best final engineering solution.

In the proposed design, the possibility of connecting and disconnecting the Power Unit from the Walking Platform are due to the Connecting Mechanism detailed in FIG. 5A. According with the proposed design, two Connecting Mechanisms permanently mount at each side of the Main Frame of the Power Unit (see FIG. 4B) and join the Power Unit to Part A of the Walking Platform (see FIG. 3). Two details are important for the proposed connection process: the first detail regards the Holes (22) on the Supportive Brackets (10), which connect the Power Unit to Part A of the Walking Platform. The second detail is small but critical for proposed design, pertaining to the Connecting Pins (13) attached on both sides of Part A of the Walking Platform.

FIGS. 5A, 5B, 5C, 5D and 5E depict the mechanics of the Connecting Mechanism which joins the Power Unit and Part A of the Walking Platform. Connecting Mechanism consists of the Holding Hand (14), Pushing Rod (19), Locking Pins (20), and Spring (21). During the connection process, the Pushing Rod (19) is pushed down toward the spring. Locking Pins (20) then rotate and both sides of the Connecting Mechanism are placed into the Supportive Brackets (10) of Part A of the Walking Platform. Once both sides of the Connecting Mechanism are completely moved into the Supportive Brackets (10) and the Locking Pins (20) are placed in front of the holes in the Supportive Bracket (10), the Pushing Rods (19) are released. The Springs (21) also simultaneously release and push the Locking Pins (20), which rotate and angle into two holes in each of the Supportive Bracket (10). This final mechanism completes the seamless connection of the Power Unit to Part A of the Walking Platform.

Proposed connection process of the Power Unit to Part A of the Walking Platform is shown on FIGS. 5F and 5G. When the Power Unit requires connection to the Walking Platform, the first step is to insert Holding Hands (14) over the Connecting Pins (13) on both sides of Part A of the Walking Platform. Next, two Pushing Rods (19) are pushed downward so that Locking Pins (20) may insert into Supportive Brackets (10) (see FIG. 5D). Once the Pushing Rods (19) are pushed down, the entire Power Unit turns over the Connecting Pins (13) and moves into the Final Connecting Position. Then both Pushing Rods (19) are released, causing Locking Pins (20) to fall into two holes in each of the Supportive Bracket (10) (see FIGS. 5B and 5E), completing the connection. Gravity pushes the Power Unit down; driving the Moving Roller (17.2) against the Walking Belt (6) and the Leading Roller (4) (see kinematics diagram on FIG. 4D).

The proposed design is not final; it only interprets the feasibility of the idea of how the Power Unit could be connected and fixed at specific positioning against the Walking Platform, so that the rotation can be transformed from the Motor (17) to Leading Roller (4).

Position shown in FIG. 6 is the proposed position for transporting the Walking Platform. Unfolded or "Treadmill" Position is shown on FIG. 1. Those two positions require actual lock of Locking Mechanism (7). All other positions of Walking Platform form the Adjustable Base of Office Chair. According to the proposed design, the Locking Mechanisms are not locked while the Walking Platform is forming the Adjustable Base of Office Chair.

FIGS. 7A, 7B and 7C presents several steps, according to proposed design, which are necessary to bring the Office Treadmill into the "Office Chair" position, as follows:

Step One: Disconnect the Power Unit from the Walking Platform (this process is the reverse of the process shown in FIGS. 5G and 5F);

Step Two: Attach the Vertical Chair Frame (24) to the Walking Platform;

Step Three: Adjust the Horizontal Bar (26) to a specified height by using the Tightening Screws (25) on both sides of the Vertical Chair Frame (24);

Step Four: First, release the Locking Mechanisms on both sides of the Walking Platform; next, lift and turn Part A of the Walking Platform; then, rest it on the Horizontal Bar (26) of the Vertical Chair Frame (24); finally, fasten the Vertical Chair Frame (24) to Part A of the Walking Platform (actual locking mechanism is omitted for simplicity).

These four steps complete the formation of the Base of Office Chair.

FIG. 7B presents the Soft Chair Parts consisting of:

Seat (27);

Seatback (28); and

Seat's Frame (29) connects parts (27) and (28) together, forming one Soft Chair Part.

The final step of transformation from Office Treadmill into "Office Chair" is as follows:

Step Five: Connect the Soft Chair Part to the Base of Office Chair by attaching Soft Chair Part to the Vertical Chair Frame (24). FIGS. 7C and 7D show the Soft Chair Part connected to the Base of Office Chair in two extreme positions:

Adjusted to maximum height above floor level, and

Adjusted to lowest height.

The transformation of Walking Platform into the Treadmill position is a simple reversal process:

Step One: Disconnect Soft Chair Part from the Base of Office Chair;

Step Two: Release the lock between Part A of the Walking Platform and Chair Frame (24) (actual locking mechanism is omitted for simplicity);

Step Three: Unfold Part A of the Walking Platform, bring the Walking Platform into the Treadmill position, and lock the Locking Mechanisms.

Step Four: Detach Vertical Chair Frame (24) and Horizontal Bar (26) from the Walking Platform; then, attach the Power Unit to the Walking Platform (FIGS. 5G and 5F).

Finally, FIG. 8 illustrates the components of the proposed Over-the-Desk Platform:

Two Locking Clips (30) connect the Platform to the Working Desk (31);

Four Adjustable Legs (32) allow vertical adjustment of the Platform height;

Top Platform (33) holds a computer keyboard and mouse, or a laptop computer;

"Stop" (34) can be adjusted via the Stop's Lock (35); after loosening the Stop's Lock (35), the Stop (34) can be moved forward or backward.

The advantages of an active lifestyle over a sedentary lifestyle are broadly recognized today by the medical community. For example, a daily target of 10,000 steps was proposed. The same activity has been recommended by the U.S. Surgeon General and the U.K. Department of Health. The Office Treadmill not only brings active lifestyle advantages to office workers who occupy one of the most sedentary jobs, it also allows new opportunity to complete daily required body movements while working, without compromising the amount and quality of office work. One definition of the term "fitness" is the "condition of being physically fit and healthy". The treadmill is traditionally designated as "intensive" fitness and/or sports equipment and, therefore, is normally in use after working hours. However, the Office Treadmill is not designed to provide "intensive" fitness or sports-related exercises to athletes. The goal of this invention is to supply sedentary workers with a useful tool to permit movement, namely walking, while working, thereby releasing workers from being perpetually seated to perform daily work duties. The "soft" fitness goal of 10,000 steps a day is also possible, but not required, by the proposed design. Accordingly, the inventor proposes that the Office Treadmill invention belongs in the category of office equipment, rather than the fitness or sports equipment category.

The main technical ideas proposed in the Office Treadmill are summarized in the claims below, while the actual design of each part of the Office Treadmill may bear great disparities from presented illustrations. The figures and descriptions in this patent application present only the simplest, one of possible manually folded designs of the Office Treadmill. Semi-automated and fully automated designs may be developed, but they will also be based on the accompanying claims. Separation or folding of the Power Unit from the Walking Platform provides the possibility of further transformation of the Walking Platform to achieve other construction advantages. According to the above proposed design, the Office Treadmill can transform from a treadmill into an Office Chair and vice versa. Another design may incorporate a treadmill paired with different office furniture; for example, the Office Treadmill may be used in cooperation with a bookshelf or pulled out from under an office desk. Claims broaden the possibilities for new designs. For example, the automated design may require division of the Walking Platform into three (or more) parts. If divided into three parts, one of the parts may form the seat, while the other parts may form legs for the Office Chair. Conversely, the other parts may also fold up to form chair arms, transforming the Office Treadmill into an armchair. Claims allow further disconnection of the Office Treadmill parts. Not only can the Power Unit be disconnected, but the Seat, Legs, Rollers, Walking Platform, and other parts may also be disconnected or collapsed. For example, further disconnection may permit easier transportation or storage. Finally, the treadmill may consist only of the Walking Platform and the Power Unit may be incorporated and designed as part of one segment of the Walking Platform.

One features that distinguishes the Office Treadmill from existing fitness equipment is that the Office Treadmill does not limit office workers from performing duties while walking. The "Stop" device is a key element in facilitating fully automated, seamless walking movements to completely free the worker's upper body and arms for any necessary office tasks, like typing, drawing, using computer or reaching objects on a desk.

Operation

In use, the present disclosure provides three main operating positions for the Walking Platform:

The "Treadmill" or "Walking" position (FIG. 1) is designed to relieve the office worker from the necessity of sitting the entire day to perform office duties.

The Over-the-Desk Platform (FIG. 8) is suggested for use during "walking-while-working" activity to insure non-limiting office work conditions.

The "Folded" or "Transportation" position (FIG. 6) adds mobility and allows separate transportation or storage of each part of the Office Treadmill, eliminating the struggle of transporting or storing one large, bulky unit. Parts of the Office Treadmill can either be disconnected in several pieces or folded for purpose of easier transportation.

The "Chair" position (FIGS. 7A, 7B, 7C, 7D, 7E, and 7F) permits use of the Office Treadmill as an office chair when the office worker desires to assume the traditional sitting position to continue office duties.

Operation of the Over-the-Desk Platform is regulated by several features incorporated in the proposed design, as shown in FIG. 8:

Connection of the Platform to an office desk,

Vertical adjustment of the Platform height,

Placement of a computer keyboard and mouse or laptop computer on the Platform, and Adjustment of the Stop.

Given the above adjustments, the office worker may place the Office Treadmill in the Treadmill position in front of the office desk and use the treadmill in the usual manner. The main differences between using a conventional Under-the-Desk treadmill and the innovational Office Treadmill are:

The user may lean on the Stop to optimally control body positioning and movement, The Stop supports the body in the approximate upper waist area, releasing upper body and both hands for any possible work scenario at the office desk; and Walking speed may be carefully adjusted (usually lowered, compare to usual fitness or sport use) to achieve automatic, seamless movement.

The preceding conditions allow the Office Treadmill user to fully concentrate on his/her office duties, due to the emphasis of design on office duty performance rather than exercise. The Office Treadmill provides relief from the sedentary nature of office work by allowing "working-while-walking" activity. The fitness effect of the Office Treadmill is a complementary result rather than a goal.

Stationary position is defined as maintaining the current walking position and not moving forward while using the Office Treadmill. Stationary position is achieved by placing the Stop in front of the moving body. The Stop supports the body at the approximate lower waist area, permitting the lower body to freely move on the Walking Platform while the entire body above the waist is free to perform any kind of office work including reading, typing, using computer, and reaching any object on the office desk.

REFERENCE NUMBERS

1—Protective Cover
2—Frame A of Walking Platform
3—Frame B of Walking Platform
4—Leading Roller
5—Adjustable Following Roller
6—Walking Belt
7—Locking Mechanism
7.1—Puller with Handle
7.2—Turning Plate 1
7.3—Turning Plate 2
7.4—Spring
7.5—Pin
7.6—Hole for Pin 7.5
7.7—Locking Holes Locking position: Spring (7.4) drives the Puller (7.1) into Locking Holes (7.7).

Turning position: Use Handle to pull the Puller (7.1) out of Locking Holes (7.7); Turning Plates 1 and 2 are free to turn around the Puller (7.1).

8—Running Deck A
9—Running Deck B
10—Supportive Bracket
11—Bracket with Adjusting Mechanism
11.1—Adjusting Bolt
12—Leg
12.1—Bracket
12.2—Bolt
12.3—Base
13—Connecting Pin
14—Holding Hand
15—Main Frame of the Power Unit
16—Motor Mounting Plate
17—Electrical Motor
17.1—Parts of Reduction Mechanism
17.2—Moving Roller
18—Office Chair Roller
18.1—Bracket
18.2—Plastic Body
18.3—Office Chair Roller
19—Pushing Rod
20—Locking Pins
21—Spring
22—Holes at the Supportive Brackets
23—Holes at the Brackets with Adjustable Mechanism
24—Vertical Chair Frame
25—Tightening Screws of Adjustable Chair Frame
26—Horizontal Bar
27—Seat

28—Seatback
29—Seat Frame
30—Locking Clips
31—Working Desk
32—Height-Adjustable Legs
33—Top Platform
34—"Stop"
35—Stop's Lock

The invention claimed is:

1. A convertible treadmill comprising:

a foldable walking platform having multiple segments;

a power unit;

a motor coupled to the power unit and configured to actuate the platform; and a stop feature, wherein said stop feature supports the user to keep the user in a stationary position to perform office work;

wherein the walking platform includes two segments rotatable with respect to one another and transitionable between a use condition in which they are aligned with one another in a same plane, and a stored condition in which they are not aligned, and wherein the two segments are coupled together via at least one locking mechanism.

2. The convertible treadmill of claim 1, wherein the power unit is separable from the walking platform.

3. The convertible treadmill of claim 1, wherein the walking platform is foldable to form or partly form office equipment.

4. The convertible treadmill of claim 1, wherein the stop features is configured and arranged to keep a user's body in a stationary position while using the convertible treadmill.

5. The convertible treadmill of claim 4, wherein the stop feature forms a part of an adjustable height over-the-desk platform.

6. The convertible treadmill of claim 4, wherein the stop feature is independently supported on a desk.

7. The convertible treadmill of claim 2, wherein the power unit forms a portion of the walking platform.

8. The convertible treadmill of claim 3, wherein the walking platform is foldable to form at least a portion of a chair.

9. The convertible treadmill of claim 1, further comprising a vertical chair frame coupleable to at least one of the two segments.

10. The convertible treadmill of claim 9, wherein the vertical chair frame includes two vertically extending bars.

11. The convertible treadmill of claim 10, further comprising a horizontal bar extending between the two vertically extending bars.

12. The convertible treadmill of claim 11, wherein each of the two vertically extending bars includes a slot and wherein the horizontal bar is movable along the length of the two vertically extending bars to define a series of heights.

13. The convertible treadmill of claim 12, further comprising a seat frame coupleable to the two vertically extending bars.

14. The convertible treadmill of claim 13, wherein the seat frame includes a plurality of receptacles that fit over the two vertically extending bars.

15. The convertible treadmill of claim 14, further comprising at least one cushion coupled to the seat frame.

* * * * *